United States Patent [19]

Chielens et al.

[11] Patent Number: 4,635,704

[45] Date of Patent: Jan. 13, 1987

[54] METHOD OF CHANGING THE WIDTH OF A CONTINUOUS METAL CASTING WITHOUT INTERRUPTING THE CASTING PROCESS

[75] Inventors: Alain Chielens, Mouvaux; Rene Durinck, Villeneuve D'Ascq; Pierre Werquin, Marcq en Baroeuil, all of France

[73] Assignee: Fives-Cail Babcock, Paris, France

[21] Appl. No.: 672,801

[22] Filed: Nov. 19, 1984

[30] Foreign Application Priority Data

Nov. 23, 1983 [FR] France ..... 83 18671

[51] Int. Cl.[4] ..... B22D 11/16

[52] U.S. Cl. ..... 164/452; 164/491

[58] Field of Search ..... 164/452, 491, 436, 418, 164/154

[56] References Cited

U.S. PATENT DOCUMENTS

| | | | |
|---|---|---|---|
| 3,838,730 | 10/1974 | Nagaoka et al. | 164/491 X |
| 4,010,793 | 3/1977 | Takemura et al. | 164/491 |
| 4,134,441 | 1/1979 | Ohmori et al. | 164/491 |
| 4,356,862 | 11/1982 | Gloor | 164/491 |
| 4,413,667 | 11/1983 | Schrewe et al. | 164/452 |
| 4,505,321 | 3/1985 | Zeller | 164/436 |

FOREIGN PATENT DOCUMENTS

| | | | |
|---|---|---|---|
| 152926 | 12/1975 | Japan | 164/491 |
| 57-94450 | 6/1982 | Japan | 164/491 |

*Primary Examiner*—Nicholas P. Godici
*Assistant Examiner*—Samuel M. Heinrich
*Attorney, Agent, or Firm*—Kurt Kelman

[57] ABSTRACT

A method of changing the width of a continuous metal casting of rectangular cross section without interrupting the casting, wherein a length of the continuous casting is cast through a mold defining a cavity of rectangular cross section having a longitudinal axis, the mold having two small side walls determining therebetween the width of the continuous casting, at least one of the side walls being displaceable with respect to the longitudinal axis to change the width, which comprises the improvement of so controlling the displacement of the one side wall in response to the length of the continuous casting cast since the beginning of the width changing operation that a transition zone of changing width of the continuous casting has a predetermined length regardless of any change in the casting speed of the continuous casting during said operation.

10 Claims, 5 Drawing Figures

FIG.2
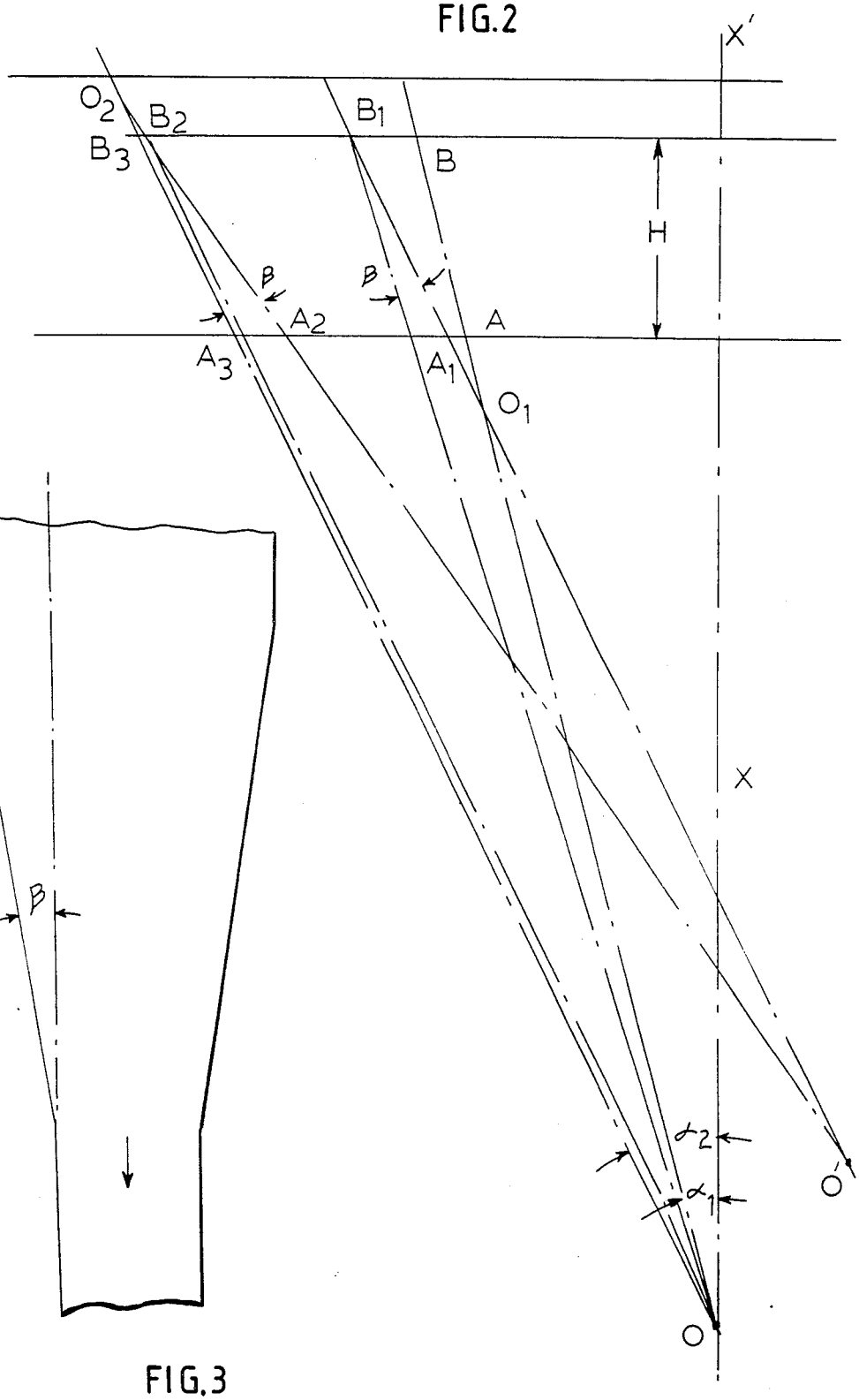
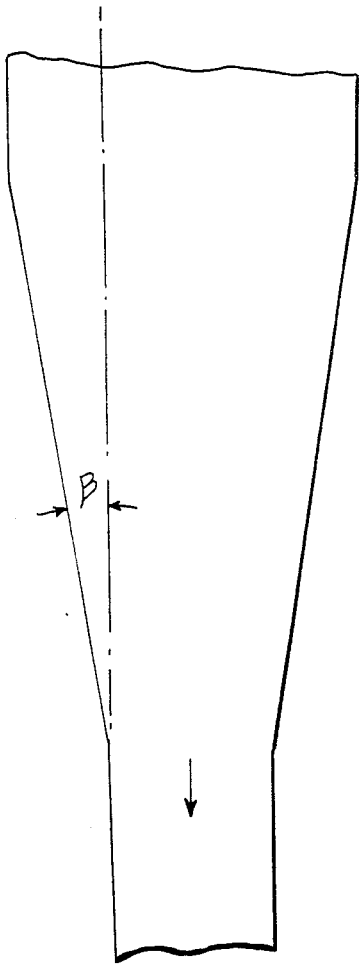
FIG.3

METHOD OF CHANGING THE WIDTH OF A CONTINUOUS METAL CASTING WITHOUT INTERRUPTING THE CASTING PROCESS

BACKGROUND OF THE INVENTION

1. Field of the Invention

The present invention relates to a method of changing the width of a continuous metal casting of rectangular cross section without interrupting the casting process, wherein a length of the continuous casting is cast through a mold defining a cavity of rectangular cross section having a longitudinal axis, the mold having two small side walls determining therebetween the width of the continuous casting, at least one of the side walls being displaceable with respect to the longitudinal axis to change the width.

2. Description of the Related Art

In conventional methods of this type, the speed of the displacement of the small side wall or walls of the mold is predetermined for the entire duration of the displacement so that the length of the section of the continuous casting which varies in width, which constitutes a zone of transition from one width to the changed width of the continuous casting, depends on the casting speed. It is not possible to obtain a transitional section of a predetermined length if the casting speed accidentally varies while the width of the continuous casting is changed. However, it is very important to be able to produce a predetermined length of the transitional seciton to reduce material losses and to facilitate laminating operations.

SUMMARY OF THE INVENTION

It is the primary object of this invention to provide a method of changing the width of a continuous metal casting of rectangular cross section without interrupting the casting process, which permits the production of a transitional section of the continuous casting of a given length, regardless of any changes in the casting speed of the continuous casting during the change of the width thereof.

The above and other objects are accomplished according to the invention by so controlling the displacement of the one side wall in response to the length of the continuous casting cast since the beginning of the width changing operation that a transition zone of changing width of the continuous casting has a predetermined length regardless of any change in the casting speed of the continuous casting during said operation.

BRIEF DESCRIPTION OF THE DRAWING

The above and other objects, advantages and features of the present invention will become more apparent from the following detailed description of a now preferred embodiment thereof, taken in conjunction with the accompanying schematic drawing wherein

FIG. 2 is a diagrammatic illustration of successive operating phases in the widening of the mold cavity;

FIG. 3 is a top view of a transitional seciton of continuously cast bloom during a widening operation;

DESCRIPTION OF THE PREFERRED EMBODIMENT

Figure 1:
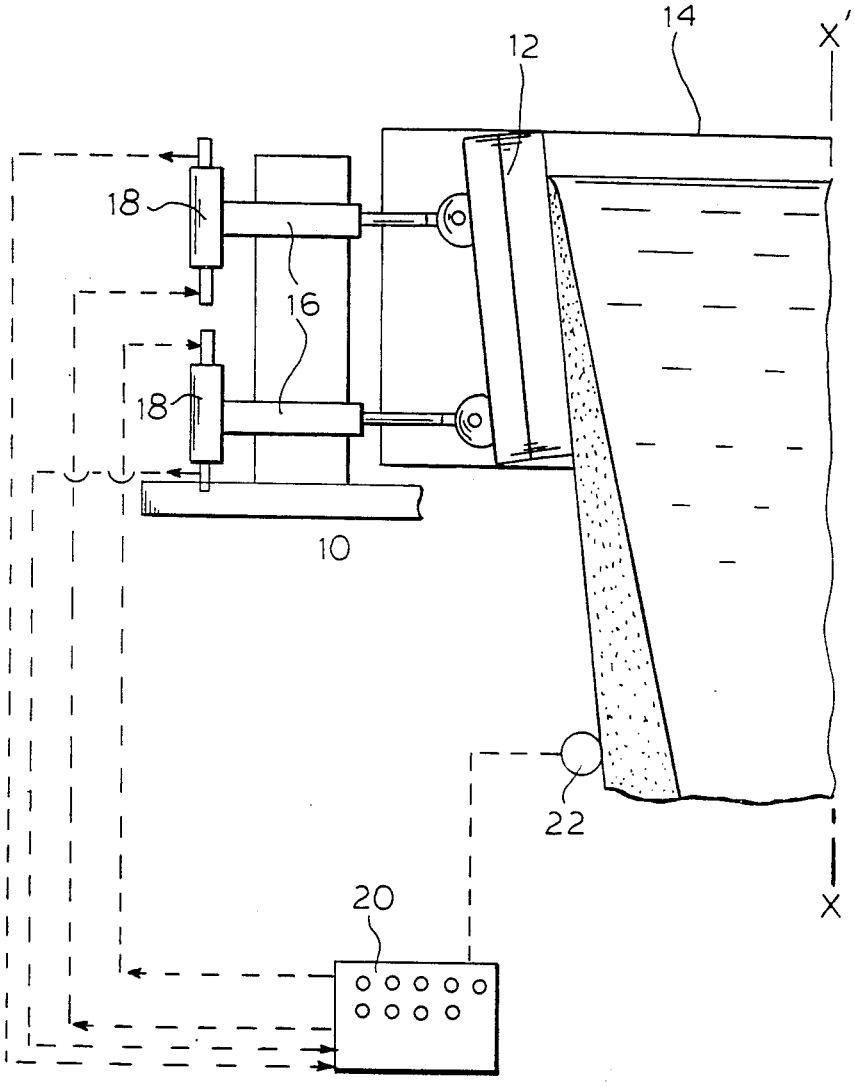
FIG. 1 is a fragmentary side elevational view showing one half of a mold controllable according to the method of this invention.

As is known and referring to FIG. 1, a mold for the continuous casting of a slab comprises casting floor or frame 10 supporting four side walls 12, 14 of a mold defining a cavity of rectangular cross section having longitudinal axis x—x'. Small side walls 12 determine therebetween the width of the continuous casting and extend between large side walls 14 which are pressed thereagainst for tight engagement therewith by suitable pressure means, such as jacks or springs. When the pressure means is de-activated, small side walls 12 may be displaced with respect to the longitudinal axis to change the width of the mold cavity and, accordingly, of the continuous casting. For this purpose, two screw jacks 16 are mounted on frame 10 for displaceably supporting each small side wall. Each screw jack is comprised of a threaded element and a nut element receiving the threaded element, one of the jack elements having an end linked to an exterior face of the small side wall of the mold and the other jack element being coupled to electrical servomotor 18 whose rotation is controlled by a programmable control, such as microprocessor or computer 20 of generally conventional design and programmed according to the method of the invention outlined hereinabove and described more fully hereinafter. Generally, there are several phases of operation for the displacement of the small side wall from its initial position to its final position, the relations between the abscissa of any point of the small side wall of the mold and the length of the continuous casting differing from phase to phase. The displacement of the small side wall is so controlled during at least a portion of the operation that the relation between the abscissa of any point of the small side wall, measured from the longitudinal axis, and the length of the continuous casting is a polynomial or that this abscissa is a linear function of the length of the continuous casting.

FIG. 2 diagrammatically illustrates the successive positions of the small side wall of the mold during displacement away from longitudinal axis x—x' of the mold cavity to widen the same. As is well known, a mold used in the continuous casting of metal products of rectangular cross section, such as steel slabs, may be straight or curved. In straight molds, the longitudinal axis of the mold cavity is rectilinear and the four side walls of the mold are planar. In curved molds, the longitudinal walls of the mold cavity has a generally circular curvature in a longitudinal plane extending perpendicularly to the large side walls of the mold, the interior faces of the large side walls are constituted by portions of a cylindrical surface and the edges of the small side walls abutting these cylindrical surface portions have a complementary curvature. The plane of elevation of the view of FIG. 1 extends perpendicularly to small side walls 12 of the mold approximately at mid-distance between the two large side walls 14 and cannot be parallel thereto if their surface is cylindrical. The plane containing the longitudinal axis of the mold cavity is perpendicular to the plane of FIG. 1 and, therefore, if the mold cavity is curved, axis x—x' represents the projection of the cavity axis on the plane of the figure, i.e. on the median plane extending parallel to large side walls 14 of the mold. In the following description, whenever reference is made to longitudinal axis x—x', it includes the plane containing this axis. Line $A-A_3$ represents the lower or casting end of the mold and line $B-B_3$ represents the level of the free surface of the metal in the mold.

Initially, the inner face of the small side wall is in the position represented by line A–B wherein it is inclined by angle $\alpha_1$ with respect to axis x—x′ to take into account the contraction of the cast metal during its cooling in the mold. This inclination of the small side wall of the mold enables the same to remain in contact with the small face of the continuous casting practically along entire height H of the mold and thus to reduce the risks of breakthrough. It has been demonstrated and experience has verified that this inclination of the small side wall of the mold is such that the line of projection of the small side wall always passes through a fixed point 0, which is called the center of the conicity, for all widths of the continuous metal casting which can be industrially produced.

Broadly speaking, the small side of the mold is inclined at the beginning of the width changing operation with respect to longitudinal axis x—x′ by an angle $\beta$ whose tangent is equal to the slope of the small faces of the trapezoidal transition zone of the continuous casting (see FIGS. 3 and 5), and is repositioned at the end of the operation to determine the final changed width. As clearly shown in the drawing, the angle of the slope is defined between a small face of the transition zone and the plane containing the small face adjacent the casting upstream and downstream of this zone. It is preferred first to incline the small side wall relatively slowly during a first phase of the operation and then to incline it more rapidly while the small side wall is repositioned relatively rapidly at the beginning of a last phase at the end of the operation and is then repositioned more slowly.

As shown in FIG. 2, the small side wall of the mold is first pivoted about a first axis $\mathbf{0}_1$ extending slightly below the mold for inclining the same from initial position A–B into an initial intermediary position $A_1-B_1$ so that its plane forms an angle $\beta$ (see FIG. 3) measured with respect to a plane perpendicular to the plane of the drawing and whose line of projection on the drawing plane is indicated by $B_1\mathbf{0}$. This angle depends on the length of the trapezoidal transition zone and the change in the width. The position of pivoting axis $\mathbf{0}_1$ is so selected that the play between the small mold side wall and the adjoining narrow face of the continuous casting and/or the compression thereof by the small mold side wall is within acceptable limits over the entire height H of the mold.

In a second phase of the operation, the small side wall of the mold is then displaced by pivoting it about a second axis passing through point 0 and extending below the mold at a distance considerably farther from the mold than first axis $\mathbf{0}_1$ to dispose the small side wall in second intermediary position $A_2-B_2$.

Finally, in the last phase of the operation, the small side wall of the mold is repositioned by pivoting it about a third axis $\mathbf{0}_2$ extending at, or at least approximately at, the level of the free surface of the metal being cast in the mold to obtain final position $A_3-B_3$ of the small side wall of the mold. In this position, the small side wall is inclined by an angle $\alpha_2$ with respect to longitudinal axis x—x′ of the mold cavity and center 0 is located in the plane of the interior face of the small side wall. As in the first phase of operation, the position of pivoting axis $\mathbf{0}_2$ is so selected that the play between the small mold side wall and the adjoining narrow face of the continuous casting and/or the compression thereof by the small mold side wall is within acceptable limits over the entire height H of the mold. During the three phases of operation, the small side wall of the mold is displaced in direct response to, i.e. as a function of, the length of the continuous casting. In other words, abscissa $x_i$, measured from longitudinal axis x—x′, of any point of the small side wall of the mold is related to length l of the continuous casting cast since the beginning of the first operational phase by $x_i=f(\mathbf{1})$, wherein f is a polynomial at most equal to six. In practical terms, a linear function $x_i=al+b$ is used whenever possible, a and b being different parameters from one phase to the other and which may change during the same phase.

The displacement of the small side wall of the mold is controlled by jacks 16 operated by computer means 20 programmed by impose on the small side wall laws of linear displacement, the displacements of the two jacks remaining during each phase in a constant relationship which depends on the selected position of the pivoting axis.

If angle $\beta$ is relatively small, for example less than 0.005 radian the same relation $x_i=\alpha 1+b_1$ will be used during the entire first phase $a_1$ and $b_1$ being constants. If angle $\beta$ is larger, it may be necessary to change parameters a and b once or several times during the first operational phase ($a'_1$, $b'_1$—$a''_1$, $b''_1$— . . . ) so that the displacement of the small side wall proceeds relatively slowly at the beginning of the first phase and is then accelerated. Similarly, during the last phase, constants $a_3$ and $b_3$ will be used if angle $\beta$ is relatively small but if it is relatively large, the parameters ($a'_3$, $b'_3$—$a''_3$, $b''_3$— . . . ) will be changed so that the displacement of the small side wall proceeds relatively rapidly at the beginning of the last phase and is then decelerated. During the second phase, parameters $a_2$ and $b_2$ remain constant.

To operate the above-described method of changing the width of a continuous metal casting, the length of the casting is constantly measured during the entire operation, for example by friction roller 22 (see FIG. 1) pressed against a face of the continuous casting and connected to an encoding device delivering pulses whose number is proportional to the numbers of rotations of the roller and, therefore, the length of the continuous casting.

Before the width of the continuous casting is changed, the operator introduces into computer means 20 the values imposed on the width and the length of the trapezoidal transitional section of the casting. On the basis of the values fed into the computer, which permit the angle $\beta$ to be defined, the computer selects the values of parameters $a_1$ and $b_1$, $a_2$ and $b_2$, and $a_3$ and $b_3$ (and, if required, $a'_1$, $b'_1$, $a''_2$, $b''_2$, $a'_3$, $b'_3$, and $a''_3$, $b''_3$).

The computer, which is equipped with a calculating unit, calculates from the moment when the order of changing the width of the continuous casting is given and at moments separated by very short time intervals, such as five seconds, for example, the displacements to be imposed upon the two jacks 16 during the time interval which follows each such moment. Thus, at moment $t_n$, the abscissa of a reference point of each jack, which corresponds to the position the small side wall is to attain at following moment $t_{n+1}$, is calculated. For this purpose, in the relation $al+b$ selected as a function of the position of the small side wall or of the length of the continuous casting, 1 is replaced by the value measured by roller 22 since the beginning of the operation augmented by length $\Delta 1_n$ of the casting cast during the one time interval $t_n - t_{n-1}$. By utilizing the calculated abscissae as control values, servomotor 18 will bring the small side wall to the position thus determined at the moment $t_{n+1}$.

If the casting speed changes during time interval $t_{n+1} - t_n$, the length $\Delta 1_{n+1}$ of the continuous casting cast during this time interval will not be equal to $\Delta 1_n$ and the position of the small side wall will have to be corrected. For this purpose, the computer will calculate the corrected abscissae at the moment $t_{n+1}$, beginning with the actual length of the continuous casting up to this moment, then the differences between the actual abscissae and the corrected abscissae, and will subsequently correct the new abscissae calculated for the moment $t_{n+2}$.

During the second operational phase, the small side wall of the mold may be pivoted about axis O' defined by the intersection of the planes defined by the interior face of the small side wall when it is in positions $A_1$–$B_1$ and $A_2$–$B_2$, respectively, or about an axis near to O or O', instead of being pivoted about axis O.

Figures 4, 5:
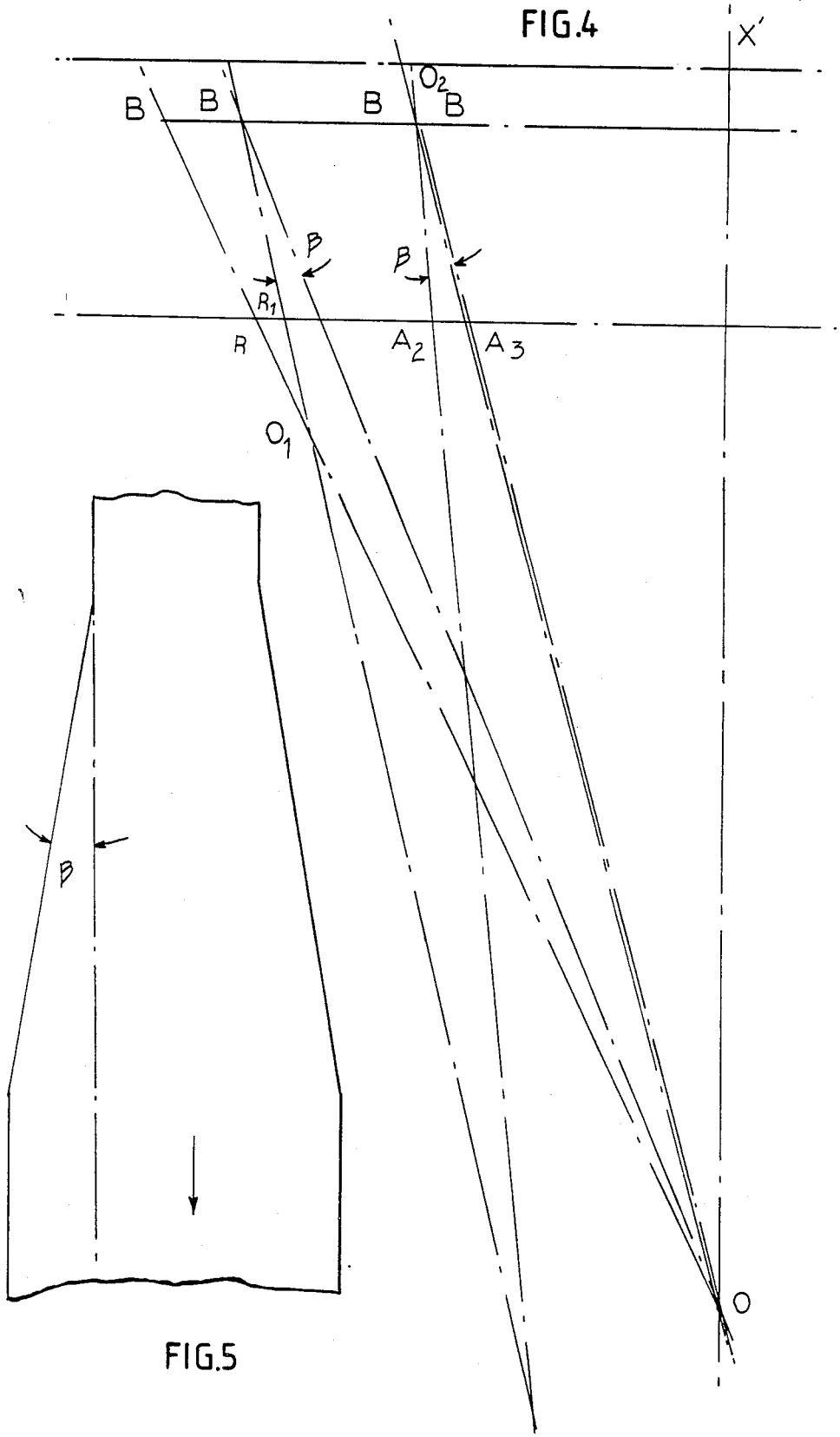
FIG. 4 is similar to FIG. 2, showing the narrowing of the mold cavity.
FIG. 5 shows a top view of the transitional bloom section produced according to FIG. 4.

To reduce the width of the continuous casting, as illustrated in FIGS. 4 and 5, the operation proceeds analogously, the small side wall being pivoted at the beginning of the operation about axis $O_1$ towards the longitudinal axis of the mold cavity by an angle $\beta$ equal to the angle of inclination of the small faces of the transitional section of the continuous casting, as measured in the manner hereinabove described. The small side wall is then pivoted about an axis passing at least approximately through O or O', as explained hereinabove, and the small side wall is then repositioned by pivoting the same about axis $O_2$ approximately at the level of the free surface of the metal in the mold.

Generally, the two opposite small side walls of the mold will be displaced simultaneously and symmetrically with respect to longitudinal axis x—x'.

What we claim is:

1. A method of changing the width of a continuously cast strand of rectangular cross-section without interrupting the casting process, wherein the strand is cast through a mold defining a cavity of rectangular cross-section with a longitudinal axis and having a small side wall which is displaceable with respect to the said longitudinal axis and is in contact with a small face of the strand, wherein said small side wall of the mold is displaced from an initial position to a final position, wherein a transitional section of the strand having a width which varies from an initial width to a final width is cast during a period of time when said small side wall is displaced from said initial to said final position, and wherein the improvement comprises the steps of;

selecting a predetermined length for said transitional section of the cast strand, initiating displacement of said small side wall from said initial position towards said final position, continuously measuring the length of the strand section cast from the beginning of the said displacement of the said small side wall, and controlling the displacement of the said small side wall in response to the length of the strand section cast from the beginning of the said displacement so that the length of the transitional section of the cast strand equals said predetermined length.

2. The method of claim 1, wherein the displacement of the said small side wall is so controlled during at least a portion of its displacement from said initial to said final position that the relation between the abscissa of any point of the said small side wall and the length of the strand section cast from the beginning of the displacement of the said small side wall is a polynomial.

3. The method of claim 1, wherein the displacement of the said small side wall is so controlled during at least a portion of its displacement from said initial to said final position that the abscissa of any point of the said small side wall is a linear function of the length of the strand section cast from the beginning of the displacement of the said small side wall.

4. The method of claim 3, comprising the further steps of selectively inclining the said small side wall at the beginning of the displacement of the said small side wall in a first direction away from said initial position by an angle whose tangent is substantially equal to the slope of the small face of the transitional section of the cast strand, the slope being defined between the small face of the transitional section of the cast strand and the plane containing the small faces of the cast strand upstream and downstream thereof, and inclining the said small side wall at the end of said displacement in a direction opposite to said first direction to bring it in said final position.

5. The method of claim 4, wherein the said small side wall is first inclined relatively slowly and then more rapidly at the beginning of the displacement of the said small side wall.

6. The method of claim 4, wherein the said small side wall is first inclined relatively rapidly and then more slowly at the end of the displacement of the said small side wall.

7. The method of claim 4, wherein the said small side wall is first pivoted about a first axis extending slightly below the mold for inclining the said small side wall into an intermediary position, the said small side wall is then displaced by pivoting it about a second axis extending below the mold at a distance considerably farther from the mold than the first axis to move the said small side wall to a second intermediary position, and the said small side wall is thereafter moved to its final position by pivoting it about a third axis extending approximately at the level of the free surface of the metal being cast in the mold.

8. The method of claim 1, further comprising the steps of:

calculating at several moments separated by short time intervals the distance over which said small side wall is to be displaced during one of the time intervals in response to the length of the strand section cast since the beginning of the displacement of the said small side wall augmented by the length of the strand section cast during the preceding time interval, controlling the displacement of the said small side wall in response to the calculated distance, comparing the actual length of the strand section cast during said one time interval with that of the strand section cast during the preceding time interval, and correcting the distance calculated at the beginning of the next time interval by a value corresponding to any difference between the compared lengths.

9. A method of changing the width of a continuously cast strand of rectangular cross-section without interrupting the casting process, wherein the strand is cast through a mold defining a cavity of rectangular cross-section with a longitudinal axis and having a small side wall which is displaceable with respect to the said longitudinal axis and is in contact with a small face of the strand, wherein said small side wall of the mold is displaced from an initial position to a final position, wherein a transitional section of the strand having a width which varies from an initial width to a final width is cast during a period of time when said small side wall is displaced from said initial to said final position, and wherein the improvement comprises the steps of:

selecting a predetermined length for said transitional section of the cast strand, inclining the said small side wall by an angle whose tangent is substantially equal to the slope of the small face of the transitional section of the cast strand by pivoting the said small side wall from its initial position to a first intermediary position about a first axis extending slightly below the mold, the slope being defined between the small face of the transitional section of the cast strand and the plane containing the small faces adjacent the cast strand upstream and downstream thereof, displacing the said small side wall from said first intermediary position to a second intermediary position by pivoting it about an axis defined approximately by the intersection of planes defined by an inner face of the said small side wall positioned, respectively, in said initial and final position, displacing the said small side wall to said final position by pivoting it about a third axis extending approximately at the level of the free surface of the metal being cast in the mold, continuously measuring the length of the strand section cast from the beginning of the displacement of the said small side wall, and controlling the displacement of the said small side wall in response to the length of the strand section cast from the beginning of the said displacement so that the length of the transitional section of the cast strand equals said predetermined length.

10. A method of changing the width of a continuously cast strand of rectangular cross-section without interrupting the casting process, wherein the strand is cast through a mold defining a cavity of rectangular cross-section with a longitudinal axis and having a small side wall which is displaceable with respect to the said longitudinal axis and is in contact with a small face of the strand, wherein said small side wall of the mold is displaced from an initial position to a final position, wherein a transitional section of the strand having a width which varies from an initial width to a final width is cast during a period of time when said small side wall is displaced from said initial to said final position, and wherein the improvement comprises the steps of:

selecting a predetermined length for said transitional section of the cast strand, inclining the said small side wall by an angle whose tangent is substantially equal to the slope of the small face of the transitional section of the cast strand by pivoting the said small side wall from said initial position to a first intermediary position about a first axis extending slightly below the mold, the slope being defined between the small face of the transitional section of the cast strand and the plane containing the small faces adjacent the cast strand upstream and downstream thereof, displacing the said small side wall from said first intermediary position to a second intermediary position by pivoting it about an axis defined approximately by the intersection of planes defined by an inner face of the said small side wall positioned, respectively, in the first and second intermediary positions, displacing the said small side wall to said final position by pivoting it about a third axis extending approximately at the level of the free surface of the metal being cast in the mold, and continuously measuring the length of the strand section cast from the beginning of the displacement of the said small side wall in response to the length of the strand section cast from the beginning of the said displacement so that the length of the transitional section of the cast strand equals said predetermined length.

* * * * *